United States Patent [19]

Housayama

[11] Patent Number: 4,752,066

[45] Date of Patent: Jun. 21, 1988

[54] FOOTSTEP EXERCISER

[75] Inventor: Akira Housayama, Inuyama, Japan

[73] Assignee: Tsunoda Jitensha Kabushiki Kaisha, Japan

[21] Appl. No.: 779,796

[22] Filed: Sep. 24, 1985

[30] Foreign Application Priority Data

Sep. 26, 1984 [JP] Japan ..... 59-201214

[51] Int. Cl.[4] ..... A63B 69/16; A63B 21/24

[52] U.S. Cl. ..... 272/73; 272/129

[58] Field of Search ..... 272/73, 129; 310/93, 310/94; 74/379

[56] References Cited

U.S. PATENT DOCUMENTS

| | | | |
|---|---|---|---|
| 3,442,131 | 5/1969 | Leyten | 73/379 |
| 3,831,942 | 8/1974 | Del Mar | 272/73 |
| 4,084,810 | 4/1978 | Forsman | 272/73 |
| 4,360,753 | 11/1982 | Shannon | 310/93 |

FOREIGN PATENT DOCUMENTS

| | | | |
|---|---|---|---|
| 1802437 | 5/1970 | Fed. Rep. of Germany . | |
| 8107360 | 3/1981 | Fed. Rep. of Germany . | |
| 1500390 | 9/1967 | France | 272/129 |
| 1279201 | 6/1972 | United Kingdom . | |

*Primary Examiner*—Richard J. Apley
*Assistant Examiner*—S. R. Crow
*Attorney, Agent, or Firm*—Berman, Aisenberg & Platt

[57] ABSTRACT

A footstep exerciser comprises a base frame assembly to be installed on a floor, a crank shaft rotatably supported on the frame assembly and provided at the opposite ends thereof with a pair of crank pedals to be stepped by a user, a flywheel of magnetic material fixedly mounted on the crank shaft for rotation therewith in a vertical plane, a pair of vertically spaced movable permanent magnets arranged adjacent the flywheel to be moved toward and away from the flywheel in a vertical plane parallel with one face of the flywheel, a support mechanism mounted on a portion of the frame assembly for supporting thereon the permanent magnets in such a manner that the permanent magnets are opposed to the one face of the flywheel with a predetermined slight clearance when moved toward the flywheel, and an actuation device operatively connected to the support mechanism for moving the permanent magnets toward and away from the flywheel and for retaining the same in their moved positions.

2 Claims, 8 Drawing Sheets

FOOTSTEP EXERCISER

BACKGROUND OF THE INVENTION

The present invention relates to a footstep exerciser of the type which includes a base frame assembly to be installed on a floor, a crank shaft rotatably supported on the frame assembly and provided at the opposite ends thereof with a pair of crank pedals to be stepped by a user, and a flywheel mounted on the crank shaft for rotation therewith.

In such a conventional footstep exerciser as described above, a frictional element such as a brake lining or roller has been adapted to effect a load acting on the flywheel by engagement therewith and to adjust the load in accordance with a pressure applied thereto. In use of the footstep exerciser for a long period of time, the frictional element is inevitably defaced, and the load acting on the flywheel is decreased in accordance with defacement of the frictional element. This means that the user may not be applied with a desired load in his stepping operation due to defacement of the frictional element and that the user is unable to accurately recognize the load acting thereto in adjustment of the frictional element. Futhermore, when the user wishes to apply a large load on the flywheel, the frictional element must be applied with a high pressure in operation of an adjusting mechanism for the exerciser.

SUMMARY OF THE INVENTION

It is, therefore, a primary object of the present invention to provide an improved footstep exerciser capable of adjusting the load acting on the flywheel as accurately as possible without provision of any frictional element.

Another object of the present invention is to provide an improved footstep exerciser capable of accurately recognizing the load acting on the flywheel in adjustment of the exerciser.

A further object of the present invention is to provide an improved footstep exerciser wherein the load acting on the flywheel can be increased by a small operational force in adjustment of the exerciser.

According to the present invention, the primary object is attained by providing a footstep exerciser which comprises a base frame assembly to be installed on a floor, a crank shaft rotatably supported on the frame assembly and provided at the opposite ends thereof with a pair of crank pedals to be stepped by a user, a flywheel of magnetic material mounted on the crank shaft for rotation therewith in a vertical plane, a movable permanent magnet arranged adjacent an outer rim of the flywheel to be moved toward and away from the flywheel in a vertical plane parallel with one side face of the flywheel, support means mounted on a portion of the frame assembly for supporting thereon the permanent magnet in such a manner that the permanent magnet is positioned to oppose the one side; of the flywheel with a predetermined slight clearance when moved toward the flywheel, and actuation means operatively connected to the support means for moving the permanent magnet toward and away from the flywheel and for retaining the same in its moved position.

According to one aspect of the present invention, there is provided a footstep exerciser which comprises a base frame assembly to be installed on a floor, a crank shaft rotatably supported on the frame assembly and provided at the opposite ends thereof with a pair of crank pedals to be stepped by a user, a flywheel of magnetic material mounted on the crank shaft for rotation therewith in a vertical plane, a pair of vertically spaced movable permanent magnets arranged adjacent an outer rim of the flywheel to be moved toward and away from the flywheel in a vertical plane parallel with one side face of the flywheel, a pair of laterally spaced stationary permanent magnets mounted on a portion of the frame assembly in such a manner that the stationary permanent magnets are positioned to oppose the one side; of the flywheel with a predetermined slight clearance, support means mounted on a portion of the frame assembly for supporting thereon the movable permanent magnets in such a manner that the movable permanent magnets are positioned to oppose the one side; of the flywheel with a predetermined slight clearance when moved toward the flywheel, and actuation means operatively connected to the support means for moving the movable permanent magnets toward and away from the flywheel and for retaining the same in their moved positions.

In a practical embodiment of the present invention, it is preferable that the movable permanent magnets are mounted on the support means in such a manner that one of the movable permanent magnets is arranged in reverse to the polarity of the other movable permanent magnet, and preferably the stationary permanent magnets are mounted on the frame assembly in such a manner that one of the stationary permanent magnets is arranged in reverse to the polarity to the other permanent magnet.

BRIEF DESCRIPTION OF THE DRAWINGS

Additional objects, features and advantages of the present invention will become more readily apparent from the following detailed description of preferred embodiments thereof when considered with reference to the accompanying drawings, in which.

DETAILED DESCRIPTION OF THE PREFRRED EMBODIMENTS

Figure 1:
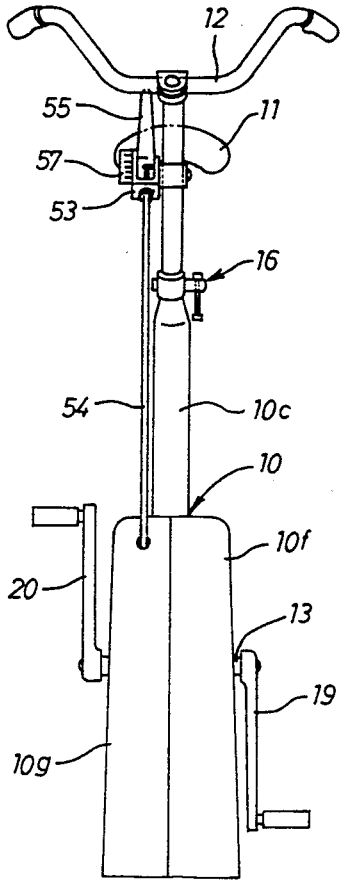
FIG. 1 is a front view of a footstep exerciser in accordance with the present invention.
Figure 2:
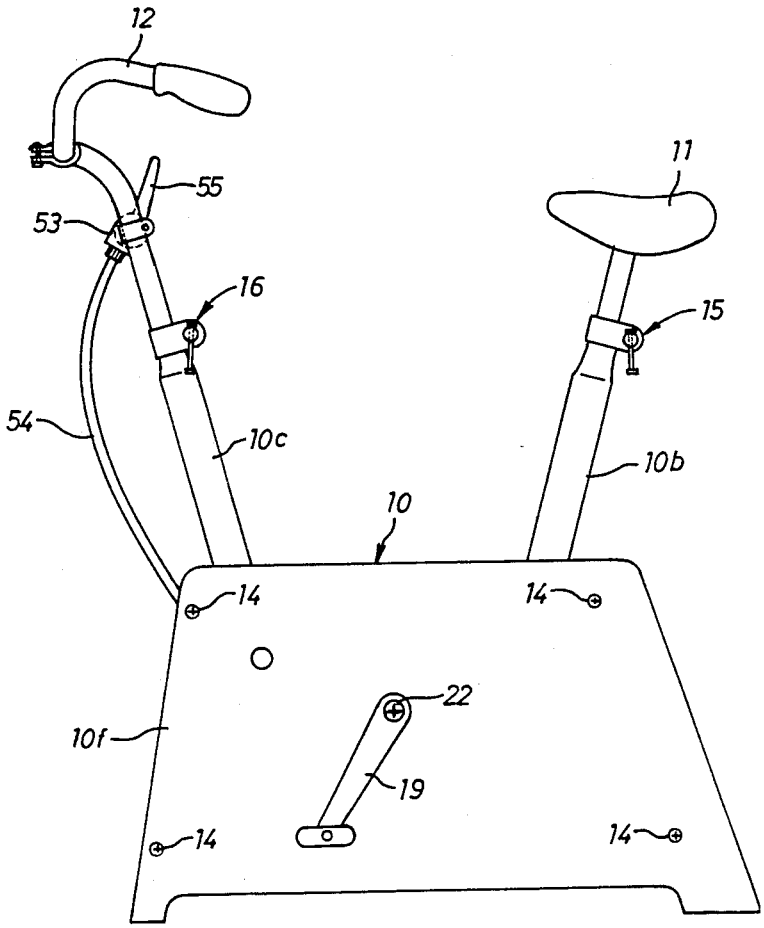
FIG. 2 is a side view of the footstep exerciser shown in FIG. 1.
Figure 3:
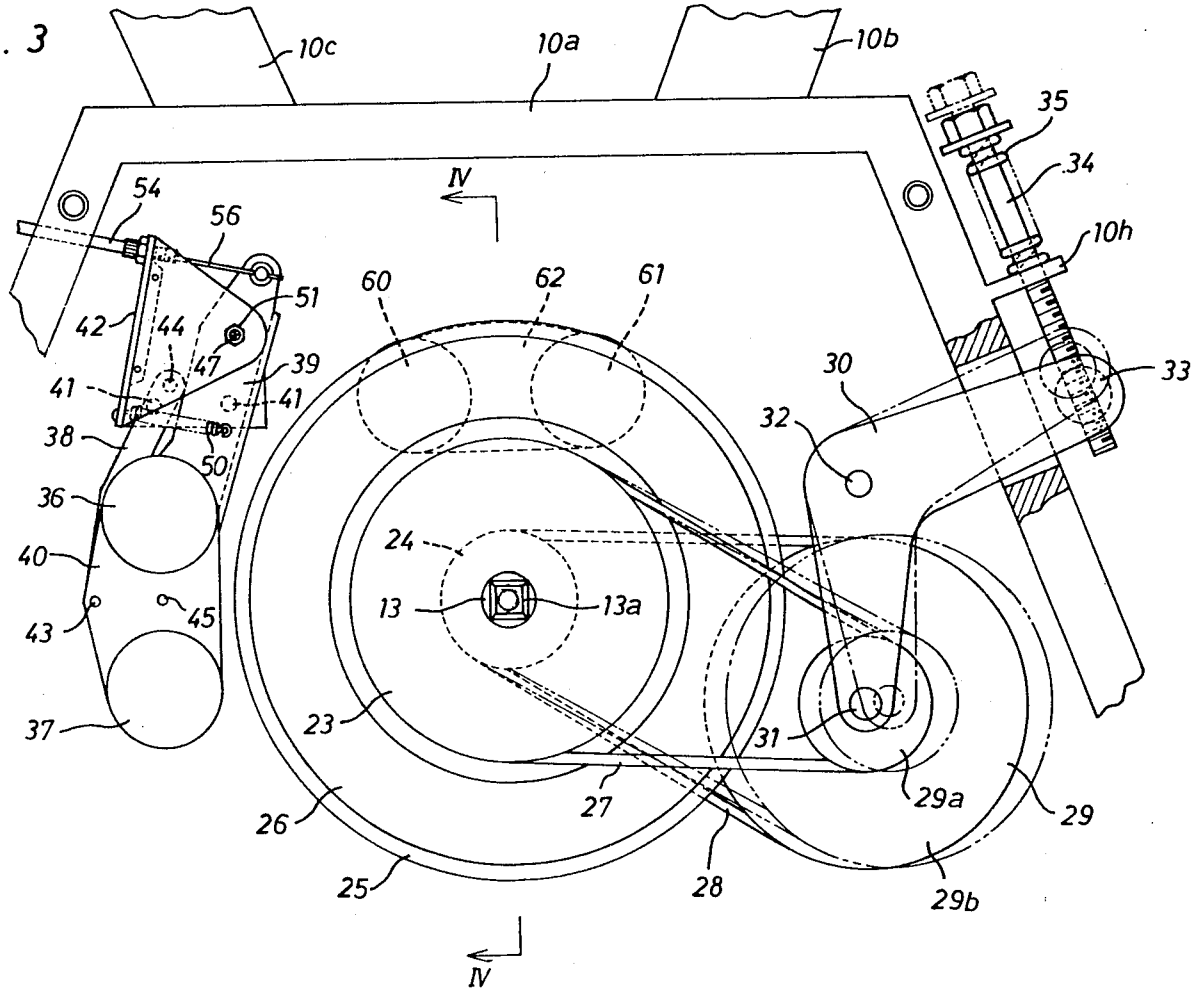
FIG. 3 illustrates the interior of a base frame assembly of the footstep exerciser shown in FIGS. 1 and 2.
Figure 4:
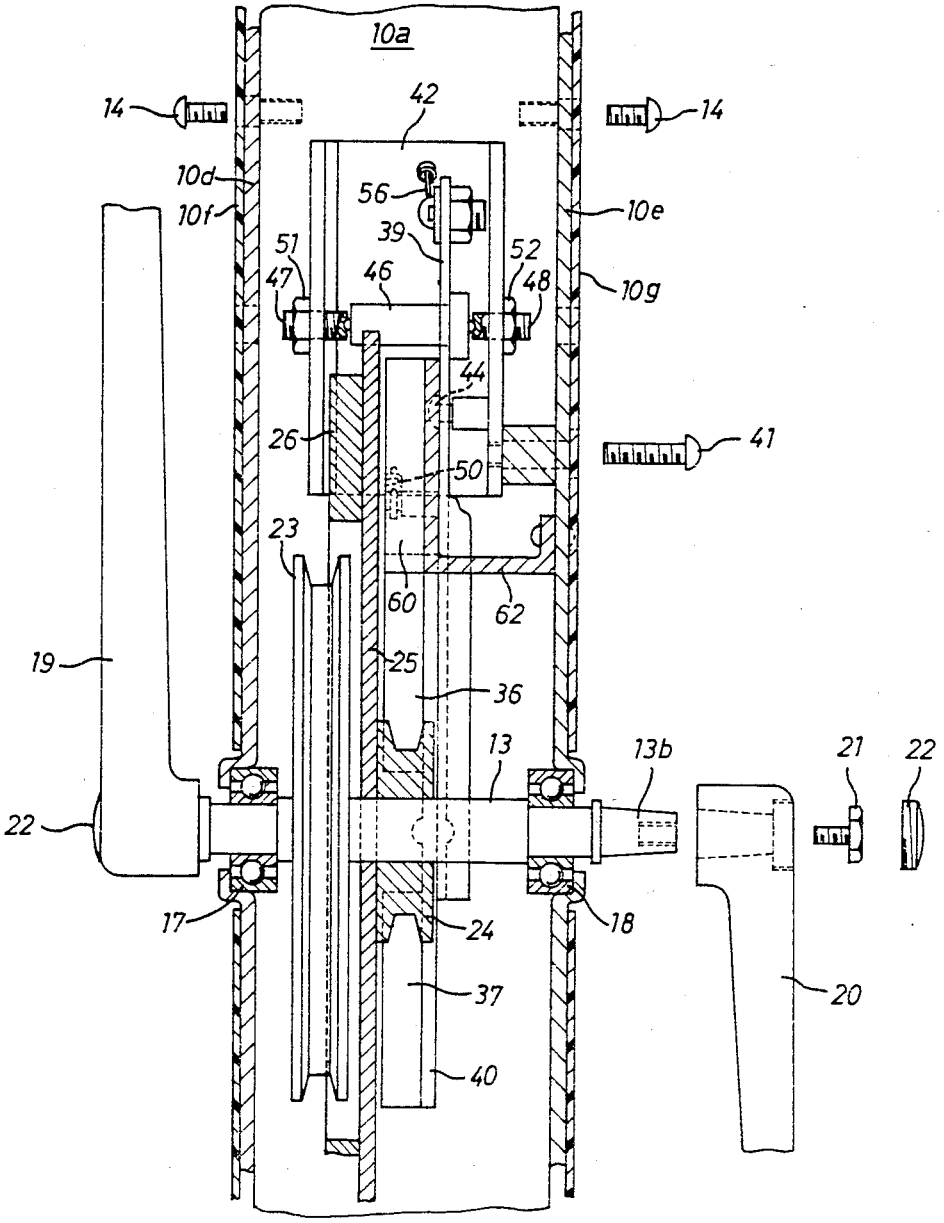
FIG. 4 is a sectional view taken along line IV—IV in FIG. 3.

Referring now to the drawings, in particular to FIGS. 1 and 2, there is illustrated a footstep exerciser in accordance with the present invention which comprises a base frame assembly 10 installed on a floor, a seat pillar **10*b* fixedly mounted on a rear part of the frame assembly 10 and provided thereon with a saddle 11, a handle pillar 10*c* fixedly mounted on a front part of the frame assembly 10 and provided thereon with a bar handle 12, and a crank shaft 13 rotatably supported on the frame assembly 10 and provided at its opposite ends with a crank pedals 19 and 20. As shown in FIGS. 3 and 4, the base frame assembly 10 includes a trapezoid main frame 10***a*, and a pair of metallic side plates 10*d* and 10*e* secured to the opposite faces of main frame 10*a* by means of screws 14 threaded into main frame 10*a* through a pair of plastic covers 10*f* and 10*g*. The seat pillar 10*b* is welded at its lower end to the upper surface of main frame 10*a*, and the saddle 11 is adjustably connected to the upper end of seat pillar 10*b* by means of a conventional clamp means 15. The handle pillar 10*c* is also welded at its lower end to the upper surface of main frame 10*a*, and the head pipe of bar handle 12 is adjustably connected to the upper end of handle pillar 10*c* by means of a conventional clamp means 16.

As can be well seen in FIGS. 3 and 4, the crank shaft 13 is rotatably supported by a pair of bearings 17 and 18 carried on the side plates 10*d* and 10*e*, and the crank pedals 19, 20 are respectively fixed to the opposite ends 13*a*, 13*b* of shaft 13 by means of a screw 21 threaded into the shaft 13 and covered with a plug 22. In the interior of the frame assembly 10, a large diameter pulley 23 is fixed to the shaft 13 for rotation therewith, and a small diameter pulley 24 is rotatably mounted on the shaft 13. A large diameter rotary plate 25 of aluminum is secured to the left end face of pulley 24, and an annular flywheel 26 of magnetic material such as iron is secured to the outer peripheral portion of rotary plate 25. Arranged adjacent the pulleys 23 and 24 is a speed-up pulley assembly 29 which includes small and large diameter pulleys 29*a* and 29*b* rotatably supported by a pair of bell crank members 30 through a pin 31. The large diameter pulley 23 is drivingly connected to the small diameter pulley 29*a* by means of an endless V-belt 27, while the small diameter pulley 24 is drivingly connected to the large diameter pulley 29*b* by means of an endless V-belt 28 to drive the rotary plate 25. The bell crank members 30 are arranged in parallel at the opposite sides of speed-up pulley assembly 29 and rotatably supported by a pin 32 which is fixed at its opposite ends to the side plates 10*d* and 10*e* of frame assmebly 10. The bell crank members 30 extend outwardly through a rear portion of main frame 10*a* and are connected to each other by means of a pin 33 at their outer ends. An adjusting bolt 34 is supported by a flange 10*h* of main frame 10*a* and threaded at its lower end into the pin 33 to hold the bell crank members 30 in an adjusted position. A compression coil spring 35 is disposed between a head of bolt 34 and the flange 10*h* of main frame 10*a*. The adjusting bolt 34 and the associated parts are contained within the plastic covers 10*f* and 10*g*. Thus, the adjusting bolt 34 is adapted to automatically adjust tension of the V-belts 27 and 28.

Arranged adjacent the front of large diameter rotary plate 25 are a pair of vertically spaced movable permanent magnets 36 and 37 which are secured to one face of a support plate 40 of iron in such a manner that the polarity of magnet 36 is arranged in reverse to the magnet 37. In this embodiment, the left side of magnet 36 is arranged as a north pole, while the left side of magnet 37 is arranged as a south pole. The support plate 40 is displaceably supported by a pair of link members 38 and 39 pivoted thereto at 43 and 45 in such a manner that the permanent magnets 36 and 37 are positioned to oppose the right side surface of rotary plate 25 with a predetermined slight clearance when the support plate 40 is moved to a position indicated by an imaginary line in FIG. 5. In such arrangement of the support plate 40, when the support plate 40 is moved to oppose to the rotary plate 25, a magnetic flux of the magnets 36 and 37 is effected in the form of a closed loop across the rotary plate 25, flywheel 26 and support plate 40.

The link members 38 and 39 are pivoted at their upper end portions to a bracket 42 of U-shaped cross-section which is fixed to the side plate 10*e* of frame assembly 10 by means of fastening screws 41. The upper end portion of link member 38 is rotatably and axially slidably supported on a pivot pin 44 fixed to the bracket 42. As shown in FIG. 4, the link member 39 is integrally provided at its upper end portion with a pivot pin 46 which is rotatably supported at its opposite ends by engagement with a pair of adjusting screws 47 and 48 respectively threaded into a pair of opposed arms of bracket 42 and fastened by lock nuts 51 and 52. A coil spring 50 is connected at its one end with the link member 39 and at its other end with the bracket 42 to bias the link member 39 clockwisely. The coil spring 50 acts to restrain attraction force of the magnets 36, 37 acting on the rotary plate 25 and to assist backward movement of the magnets 36, 37 away from the rotary plate 25. In the above arrangement, the adjusting screws 47 and 48 are adapted to laterally displace the link members 38, 39 so as to adjust the clearance between the magnets 36, 37 and the rotary plate 25.

Figure 6:
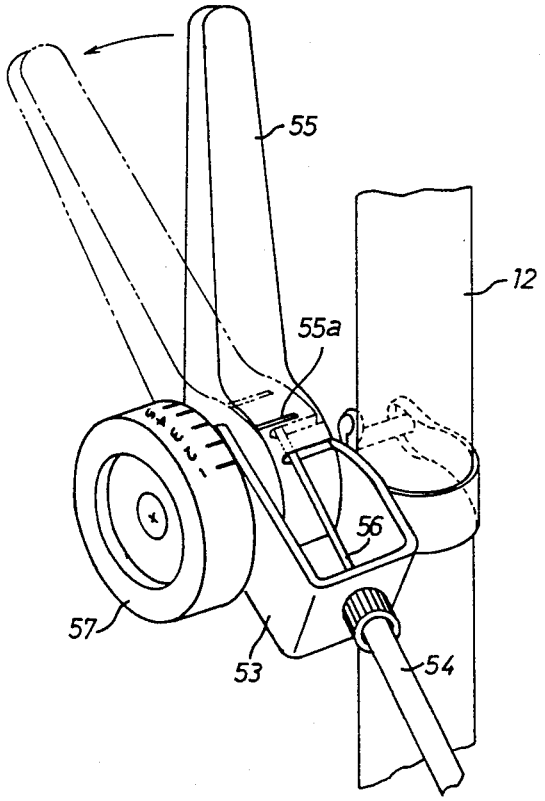
FIG. 6 is an enlarged perspective view of an operation lever shown in FIGS. 1 and 2.

For operation of the link member 39, a cable 54 is connected at its one end to the bracket 42 and at its other end to a bracket 53 fixed to the head pipe of bar handle 12. The cable 54 is provided therein with an inner wire 56 which is connected at its one end to the upper end of link member 39 and at its other end to an operation lever 55 pivotally mounted on the bracket 53 to be actuated by a user. As shown in FIG. 6, the bracket 53 is provided at one side thereof with a cylindrcial scale member 57 on which a plurality of scale marks are provided to indicate a load acting on the crank pedals 19 and 20. In this embodiment, the operation lever 55 is assembled with the bracket 53 to be retained in a selected position against the biasing force of coil spring 50 and the attraction force of magnets 36, 37 acting on the link member 39.

At the right side of the rotary plate 25, a pair of laterally spaced stationary permanent magnets 60 and 61 are further positioned to oppose to the upper portion of rotary plate 25 with a predetermined slight clearance. The magnets 60 and 61 are secured to a bracket 62 of iron in such a manner that the magnet 60 is arranged in reverse to the polarity of magnet 61. As shown in FIG. 4, the bracket 62 has a L-letter shaped cross-section and is secured to the side plate 10*e* of frame assembly 10. Thus, a magnetic flux of magnets 60 and 61 is effected in the form of a closed loop across the rotary plate 25, flywheel 26 and bracket 62.

Figure 5:
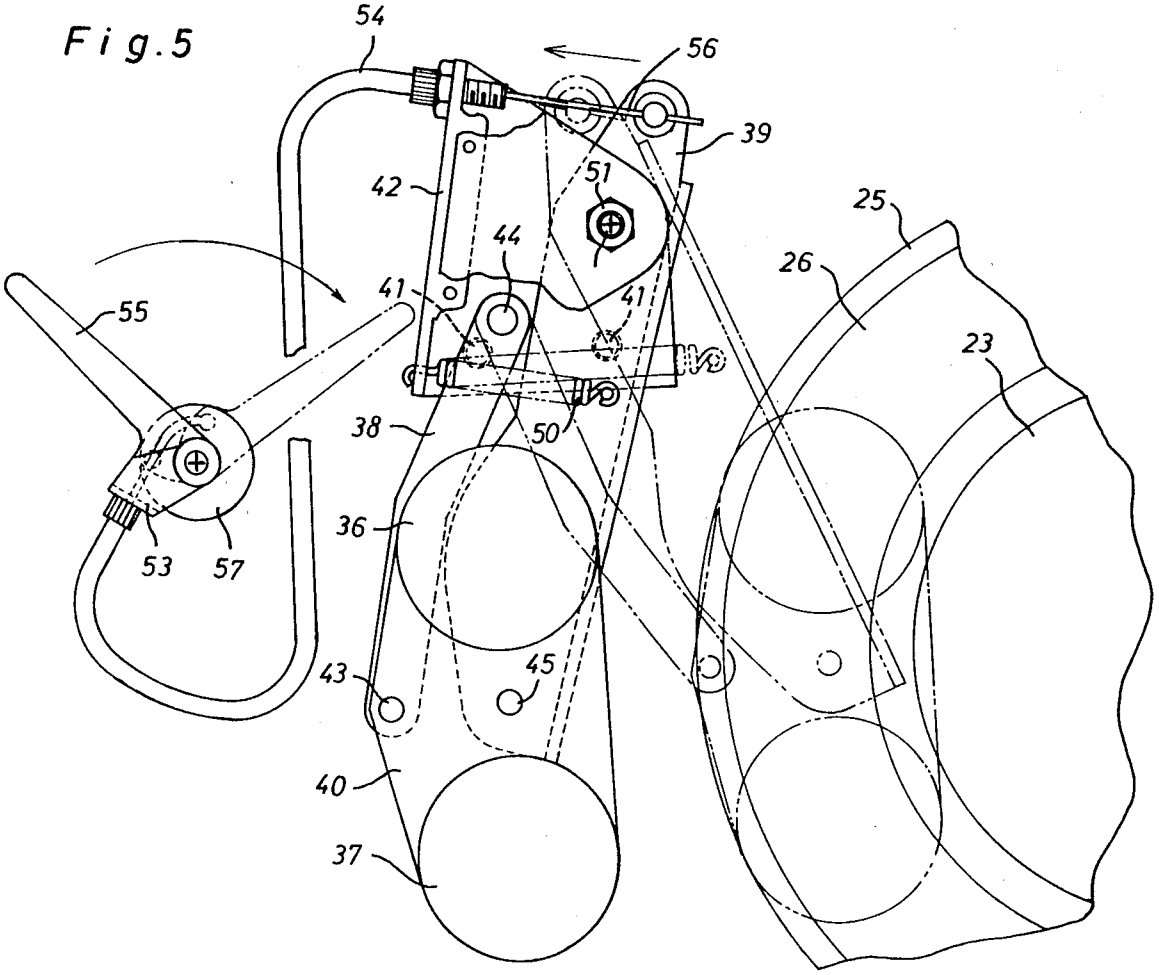
FIG. 5 is an enlarged view illustrating a portion of the interior of the base frame assembly shown in FIG. 3.

Assuming that in use of the footstep exerciser, the crank pedals 19 and 20 are stepped by a user in a condition where the support plate 40 of magnets 36, 37 is in a position shown by a solid line in FIG. 5, the large diameter pulley 23 is driven by rotation of the crank shaft 13 to rotate the pulley assembly 29 at an increased speed so as to rotate the large diameter rotary plate 25 through the small diameter pulley 24 at a further increase speed. During rotation of the rotary plate 25, the stationary permanent magnets 60, 61 act to produce an eddy current across the rotary plate 25. Thus, the rotary plate 25 and flywheel 26 are applied with a braking force caused by the eddy current, and the user is applied with a preload in his stepping operation. When the operation lever 55 is actuated by the user to move the support plate 40 of magnets 36, 37 toward the rotary plate 25 during rotation of the rotary plate 25, the permanent magnets 36, 37 are positioned to oppose the right side face of rotary plate 25 with the slight clearance, as shown by the imaginary line in FIG. 5, and act to further produce an eddy current across the rotary plate 25. Thus, the rotary plate 25 and flywheel 26 are further applied with a braking force caused by the eddy current, and the user is applied with an increased load in his stepping operation. In this instance, the eddy current across rotary plate 25 increases in accordance with forward movement of the support plate 40 toward the rotary plate 25 and becomes a maximum value when the magnets 36, 37 are entirely overlapped with the rotary plate 25.

From the above description, it will be understood that the load acting on the user is effected without causing any frictional engagement with the rotary plate 25 and is accurately controlled by adjustment of the operation lever 55 without causing any change in its displacement stroke for a long period of time. Furthermore, in use of the footstep exerciser, the maximum load acting on the user can be effected only by displacement of the magnets 36, 37 toward the rotary plate 25. For this reason, the operation lever 55 can be adjusted by the user without causing any difficulty in his operation.

Figure 7:
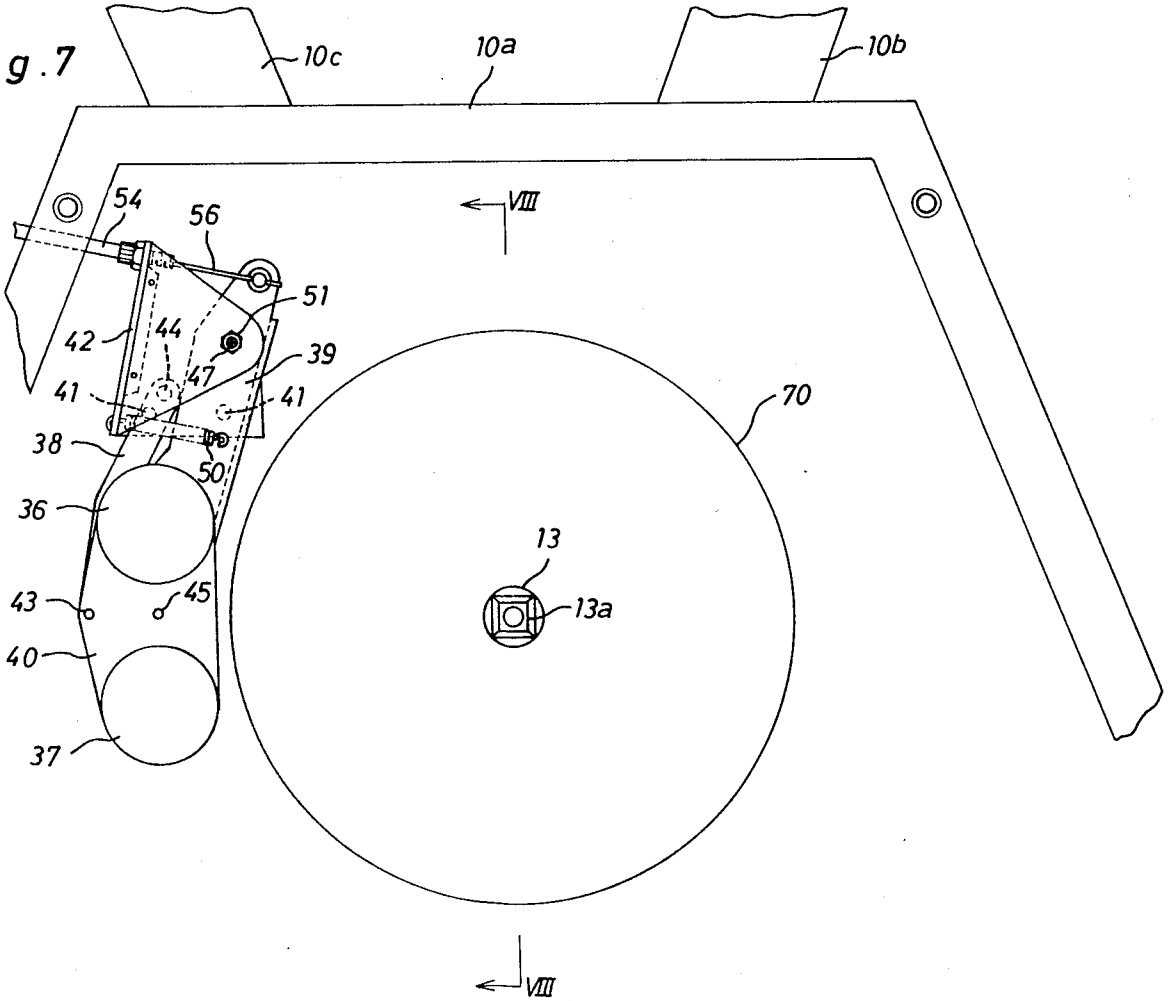
FIG. 7 is an enlarged side view illustrating a modification of the footstep exerciser shown in FIGS. 1–6.
Figure 8:
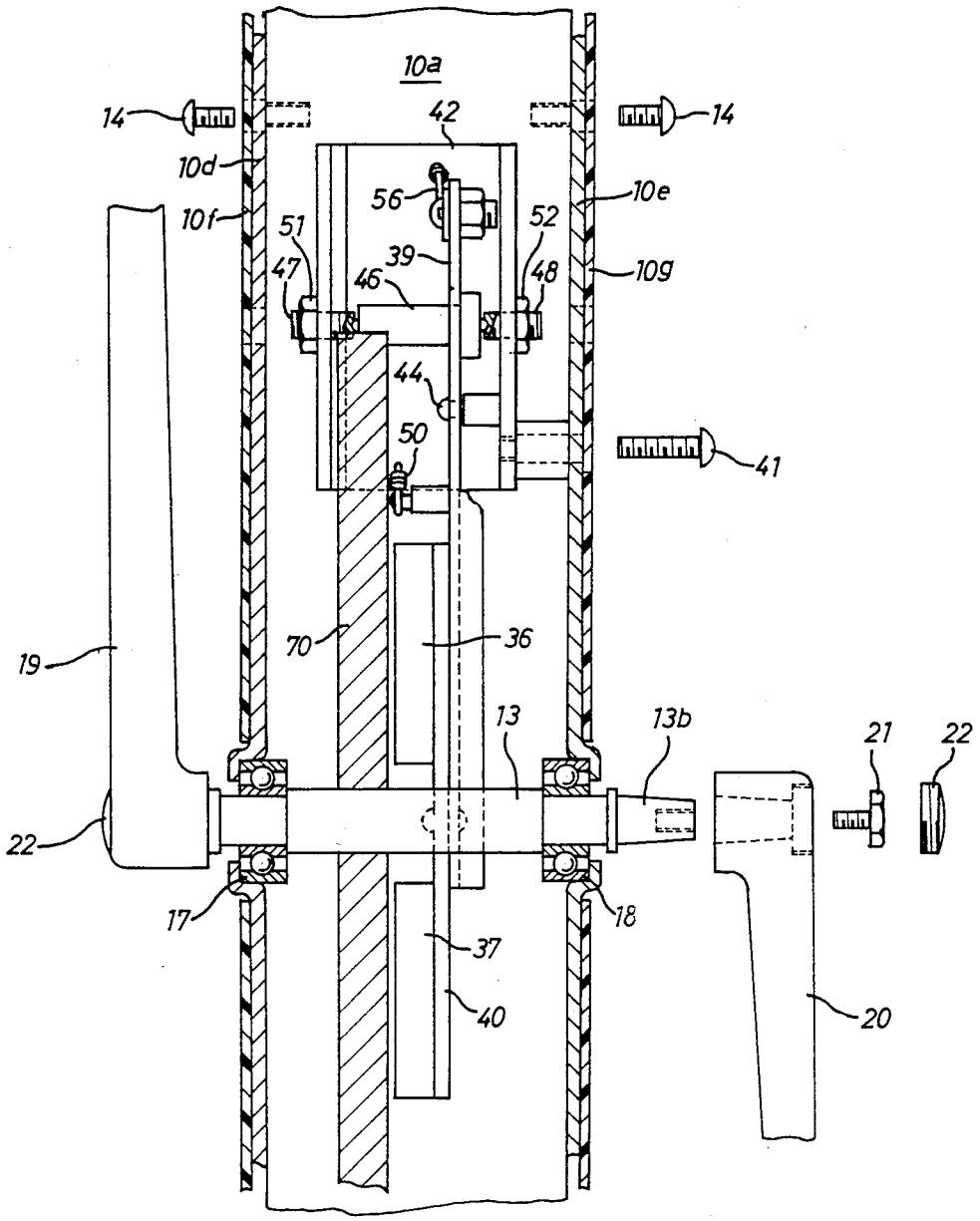
FIG. 8 is a sectional view taken along line VIII—VIII in FIG. 7.

Although in the above embodiment, the stationary permanent magnets 60, 61 have been adapted to effect a preload acting on the crank pedals 19, 20, and the speed-up pulley assembly 29 has been adapted to increase the load acting on the crank pedals, it is to be noted that as shown in FIGS. 7 and 8, the present invention can be practiced without provision of the permanent magnets 60, 61 and the speed-up pulley assembly 29. Alternatively, the pulley 24, rotary plate 25 and flywheel 26 may be replaced with a single flywheel 70 which is fixedly mounted on the crank shaft 13 as shown in FIGS. 7 and 8.

What is claimed is:

1. A footstep exerciser comprising:

a base frame assembly suitable for installing on a floor;

a crank shaft rotatably supported on said frame assembly and provided at the opposite ends thereof with a pair of user-operable crank pedals;

an annular flywheel of magnetic material mounted on said crank shaft for rotation therewith in a vertical plane;

a pair of vertically spaced movable permanent magnets adjacent an outer rim of said flywheel, said pair of magnets being movable toward and away from said flywheel in a vertical plane parallel with one side of said flywheel;

a pair of laterally spaced stationary permanent magnets for applying a preload mounted on a portion of said frame assembly, wherein said stationary permanent magnets are positioned adjacent said one side of said flywheel with a predetermined slight clearance therefrom and one of said stationary permanent magnets is arranged so that its polarity is reversed with respect to the polarity of the other stationary permanent magnet;

support means mounted on a portion of said frame assembly for supporting thereon said movable permanent magnets, one of said movable permanent magnets having its polarity reversed with respect to the polarity of the other movable permanent magnet, and said movable permanent magnets being positioned adjacent to said one side of said flywheel with a predetermined slight clearance therefrom when said magnets are moved toward said flywheel, said support means including means for adjusting the slight clearance between said movable permanent magnets and the one side of the flywheel; and actuating means operatively connected to said support means for moving said movable permanent magnets toward and away from said flywheel; whereby the magnets in each pair cooperate with each other of said pair to provide a magnetic flux in the form of a closed loop across the flywheel, the position of said magnets with respect to said flywheel determining the load to be overcome by the user.

2. A footstep exerciser comprising:

a base frame assembly suitable for installing on a floor;

a crank shaft rotatably mounted on said frame assembly and provided at the opposite ends thereof with a pair of user-operable crank pedals;

a rotary plate mounted on said crank shaft for rotation therewith in a vertical plane;

an annular flywheel of magnetic material secured to one side of said rotary plate;

a pair of vertically spaced movable permanent magnets adjacent an outer rim of said rotary plate, said pair of magnets being movable toward and away from said rotary plate in a vertical plane parallel with the other side of said rotary plate;

a pair of laterally spaced stationary permanent magnets for applying a preload mounted on a portion of said frame assembly, wherein said stationary permanent magnets are positioned adjacent the other side of said rotary plate with a predetermined slight clearance therefrom and one of said stationary permanent magnets is arranged so that its polarity is reversed with respect to the polarity of the other stationary permanent magnet;

support means mounted on a portion of said frame assembly for supporting thereon said movable permanent magnets, wherein said movable permanet magnets are positioned adjacent the other side of said rotary plate with a predetermined slight clearance therefrom when moved toward said rotary plate, and one of said movable permanent magnets is arranged so that its polarity is reversed with respect to the other movable permanent magnet, said support means including means for adjusting the slight clearance between said movable permanent magnets and said other side of said rotary plate; and actuation means operatively connected to said support means for moving said movable permanent magnets toward and away from said rotary plate;

whereby the magnets in each pair cooperate with each other of said pair to provide a magnetic flux in the form of a closed loop across the flywheel, the position of said magnets with respect to said flywheel determining the load to be overcome by the user.

* * * * *